US005839925A

United States Patent [19]

Simmons

[11] Patent Number: 5,839,925

[45] Date of Patent: Nov. 24, 1998

[54] ELECTRICAL RECEPTACLE TERMINALS

[75] Inventor: Reginald John Simmons, South Harrow, Great Britain

[73] Assignee: The Whitaker Corporation, Wilmington, Del.

[21] Appl. No.: 713,622

[22] Filed: Sep. 13, 1996

[30] Foreign Application Priority Data

Sep. 29, 1995 [GB] United Kingdom ..... 9519884

[51] Int. Cl.[6] ..... H01R 11/22

[52] U.S. Cl. ..... 439/852; 439/595; 439/752.5

[58] Field of Search ..... 439/850, 851, 439/852, 751, 752, 752.5, 845, 595

[56] References Cited

U.S. PATENT DOCUMENTS

| | | | |
|---|---|---|---|
| 3,083,351 | 3/1963 | Nielsen, Jr. | 339/217 |
| 4,032,215 | 6/1977 | Jarmofsky et al. | 339/258 R |
| 4,148,547 | 4/1979 | Otsuki et al. | 339/258 R |
| 4,379,611 | 4/1983 | Foege et al. | 339/217 S |
| 4,480,386 | 11/1984 | Adams | 29/874 |
| 4,505,531 | 3/1985 | Miller | 339/64 R |
| 4,540,233 | 9/1985 | Saijo et al. | 339/258 R |
| 4,717,356 | 1/1988 | Rahrig et al. | 439/464 |
| 4,834,681 | 5/1989 | Chaillot | 439/856 |
| 4,919,628 | 4/1990 | Mobley et al. | 439/858 |

FOREIGN PATENT DOCUMENTS

| | | |
|---|---|---|
| 0 147 076 B1 | 2/1991 | European Pat. Off. . |
| D. 648749 | 4/1985 | Japan . |
| 5-53146 | 7/1993 | Japan . |

*Primary Examiner*—Neil Abrams
*Assistant Examiner*—T. C. Patel

[57] ABSTRACT

An electrical terminal comprises a forward receptacle portion for mating with a tab. The receptacle portion as a pair of spaced opposed side walls connected by a contact spring support base and a contact spring joined to the forward end of the support base by a forwardly bowed bight. The contact spring extends obliquely and rearwardly from the bight between the side walls. For protecting the bight and the contact spring from damage by a probe a barrier comprises barrier halves projecting towards one another from the side walls, and which may have chamfered, probe deflecting upper surfaces. In order to allow a terminal to be inserted into a cavity in a housing, the cavity having a channel in its floor, the channel being of substantially the same width as the contact spring, the lower part of the bight and the adjacent part of the support base are formed as a sledge having runners which are slideable along the surfaces of the floor, on either side of the channel.

8 Claims, 3 Drawing Sheets

ELECTRICAL RECEPTACLE TERMINALS

BACKGROUND OF THE INVENTION

1. Field of the Invention

This invention relates to electrical receptacle terminals.

2. Description of the Prior Art

A known electrical receptacle terminal for reception in a cavity in an insulating housing has a rear portion for connection to an electrical conductor and a forward receptacle portion for mating with a male contact member. The receptacle portion comprises a pair of spaced, opposed side walls connected by a contact spring support base, and a contact spring joined to the forward end of the support base by a forwardly bowed bight and extending therefrom obliquely rearwardly.

Such terminals are commonly used in multi-contact electrical connectors for electrical harnesses, for example, automotive vehicle harnesses. During a harness making operation, it is usual to test circuit continuity by applying the connector to test probes on the harness board, which engage the terminals through the front of the connector housing. In some cases, for example where the terminals carry bung seals for sealing a rear of the housing, it would, in any case, be impossible to probe the terminals from the rear of the housing. The problem which is related to such test procedures, is that the contact springs of the terminals may be damaged by the test probes, especially if these have become bent as a result of long usage, for example.

SUMMARY OF THE INVENTION

According to one aspect thereof, the present invention consists in an electrical receptacle terminal for reception in a cavity in an insulating housing, the terminal having a rear portion for connection to an electrical conductor and a forward receptacle portion for mating with a male contact member, the receptacle portion comprising a pair of spaced, opposed side walls connected by a contact spring support base, and a contact spring joined to the forward end of the support base by a forwardly bowed bight and extending therefrom obliquely rearwardly, wherein a barrier extends from the receptacle portion across the bight, forwardly thereof to protect the contact spring and plating thereupon from damage by a test probe advanced towards the bight in the rearward direction of the terminal.

Thus when the terminal is lodged in its cavity in the housing, and the housing is applied to the harness board, for test purposes, the respective probe on the test board will engage the test probe barrier rather than the bight or the contact spring even if the test probe has become distorted by use.

For ease of manufacture, by means of a conventional progressive stamping and forming operation, the test probe barrier comprises a pair of barrier bars extending towards each other each from the forward end of a respective one of the side walls of the receptacle portion. Each barrier bar is preferably connected to its respective side wall by means, for example the bight, so as to be stood off forwardly from the forward end of the respective side wall, beyond the bight connecting the support base to the contact spring.

In order to take account of the case where a test probe is severely bent, the barrier bars may have chamfered surfaces for deflecting the test probe away from the contact spring.

So that the barrier bars do not interfere with the insertion of the terminal into its cavity in the housing, they preferably lie substantially above the plane of the contact spring support base.

In some cases, the cavity for receiving the terminal may have a floor formed with a hole for receiving a latch member of a secondary locking device for ensuring that the terminal cannot back out from its cavity. In moulding the housing, using conventional coring techniques, the floor must also be formed with longitudinal channel communicating with the hole. Since the width of the channel will usually approximate to the width of the bight and the contact spring, and since the edges of the bight are rough sheared edges rather than being smooth surfaces, and since the terminal needs to be slid along the channel centrally thereof, the rough edges of the bight tend to scrape along the edges of the channel thus undesirably increasing the insertion force of the terminal into its cavity.

According to another aspect thereof, the present invention consists in an electrical terminal for insertion in a cavity in an insulating housing, the terminal having a forward receptacle portion for mating with a male contact member, the receptacle portion comprising a contact spring support base and a contact spring joined to the forward end of the support base by a forwardly bowed bight and extending therefrom obliquely rearwardly, wherein the forward end portion of the contact spring support base and a portion of the bight adjacent thereto are laterally enlarged to provide a sledge, of greater width than the remainder of the bight and having laterally projecting runners with smooth rolled undersides for sliding on respective wall surfaces of the cavity, which are spaced from one another by approximately the width of the remainder of the bight.

Thus, no rough surfaces of the terminals can scrape along the edges of the spaced wall surfaces, that is to say the edges of the channel, to impede the insertion of the terminal into its cavity.

DETAILED DESCRIPTION OF THE PREFERRED EMBODIMENT

Figure 1:
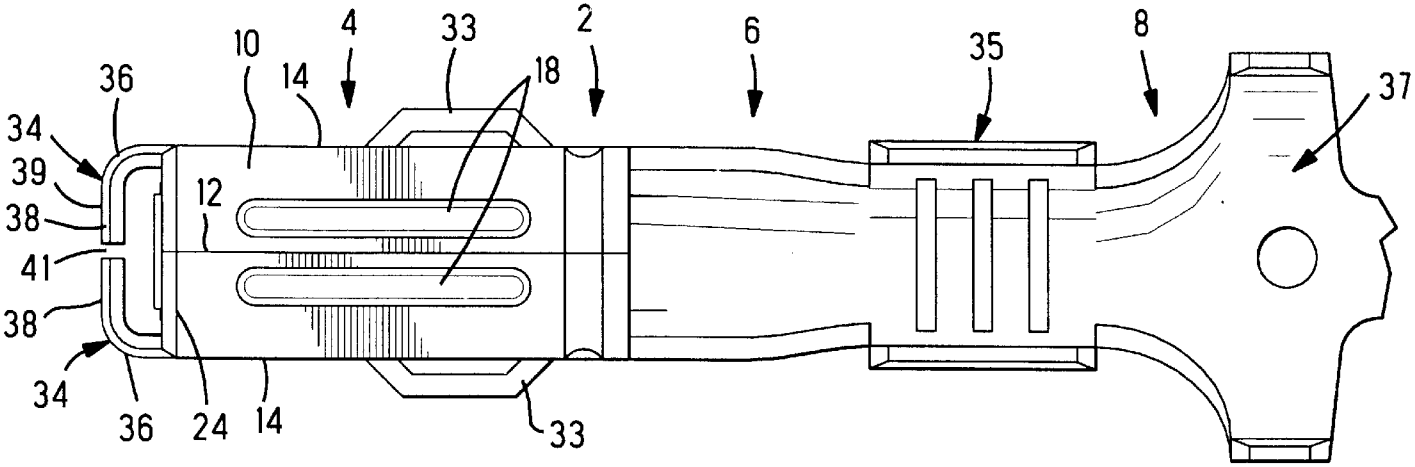
FIG. 1 is a greatly enlarged top plan view of an electrical receptacle terminal according to an embodiment of the present invention.
Figure 2:
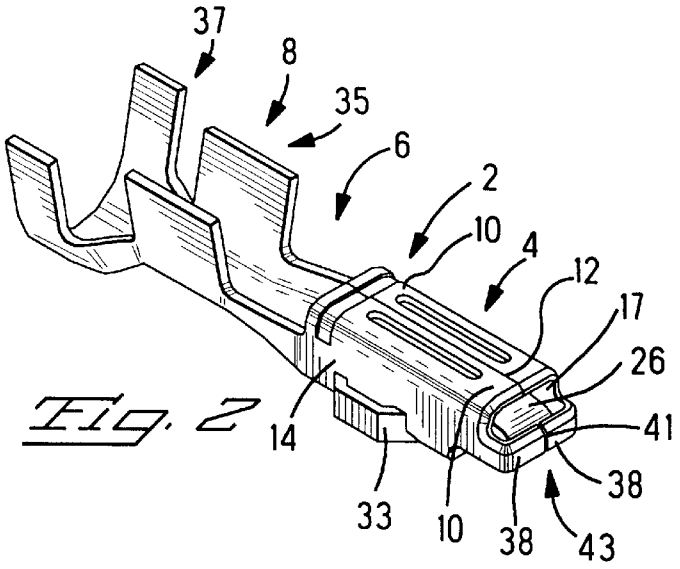
FIG. 2 is an isometric view of the terminal drawn to a smaller scale than FIG. 1.

As best seen in FIGS. 1 to 4 a one-piece stamped and formed electrical receptacle terminal 2 comprises a forward receptacle portion 4, an intermediate portion 6, and a rearward crimping ferrule portion 8. The receptacle portion 4 is tubular, having been formed in a progressive stamping and forming operation, from a blank, to provide a roof 10 having a longitudinal seam 12, spaced, opposed side walls 14 and a base 16. The receptacle portion 4 has a forward open end 17 and an open rear end 19. There project inwardly from the roof 10 two spaced longitudinal rails 18 presenting arcuate contact surfaces which are preferably plated with gold over nickel.

The base 16 comprises a contact spring support base 22 joined by a bight 24 to a contact spring 26 which projects obliquely rearwardly beneath the rails 18. The contact spring 26 has a smoothly arcuate contact surface 28 which is gently curved to ease the insertion and withdrawal forces of a male contact member in the form of mating tab T. The crest of the contact surface 28 is preferably selectively plated with a gold over nickel contact spot. A contact spring overstress beam 30 struck from the base 16 projects forwardly to a position beneath a flat 32 on the bottom of the rear end portion of the contact spring 26. Rearwardly of the open end 17 of the receptacle portion there projects from each side wall 14 a stabilising ear 33. The intermediate portion 6 of the terminal 2 is of U-shaped cross section, joining the receptacle portion 4 to an open wire barrel 35 which is in turn joined to a rearward open insulation barrel 37. The receptacle portion may be of the order of 0.7 cm in length and 0.28 cm in width, its stock thickness being correspondingly small.

Forwardly of the bight 24 there projects from the lower part of the forward end of each side wall 14 an anti-probe stress barrier half 34. Each probe barrier half 34 comprises a bight 36 connecting a barrier arm 38 to the respective side wall 14. Each barrier bar has a chamfered, probe deflecting upper edge 39. Each barrier bar 38 extends across the forward open end 17 of the receptacle portion 4 at a position opposite to the bight 24 and is stood off forwardly therefrom by the respective bight 36. The barrier bars 38 lie substantially below the contact surface 28 of the contact spring 26. The barrier halves 34, which extend towards one another are only separated by a small gap 41 and present a complete stubbing or probe barrier 43 extending across the open end 17. Since this barrier 43 comprises the two halves 34, one of which is formed with each side wall 14, the barrier can readily be provided during the forming and stamping operation when the receptacle portion 2 is rolled up.

Figure 3:
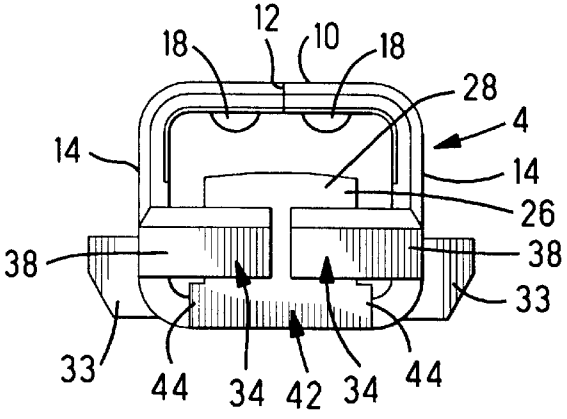
FIG. 3 is a front view of the terminal.
Figure 4:
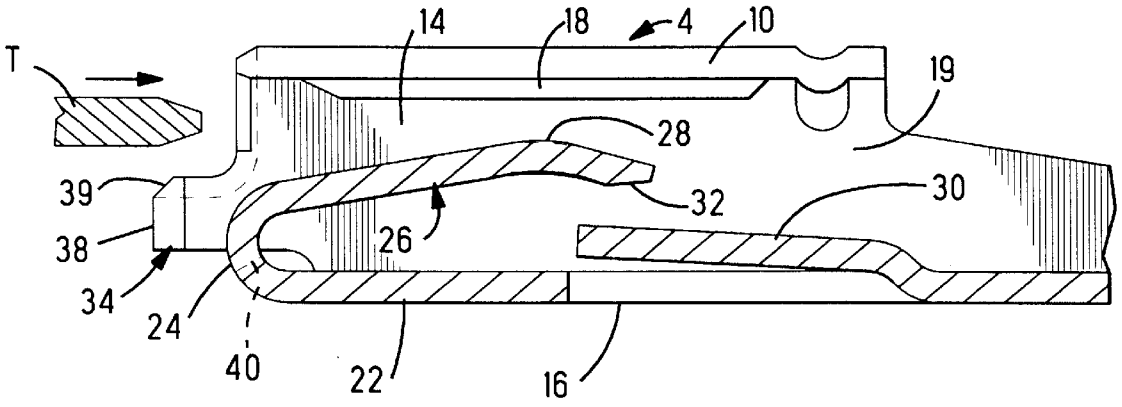
FIG. 4 is a longitudinal sectional view of a receptacle portion of the terminal with a tab, shown in fragmentary form, about to be mated with the receptacle portion.

The forward end portion of the contact spring support base 22 and a portion of the bight 24, from the position referenced 40 in FIG. 4 are laterally enlarged to provide a sledge, generally referenced 42, of greater width than the remainder of the bight 24, as best seen in FIG. 3. The sledge 42 comprises laterally projecting runners 38 with smooth rolled undersides. That is to say they have no rough sheared under surfaces. The purpose of the sledge 42 is described below. The runners 44 are of the same stock thickness as the bight 24 and the base 22.

Figure 5:
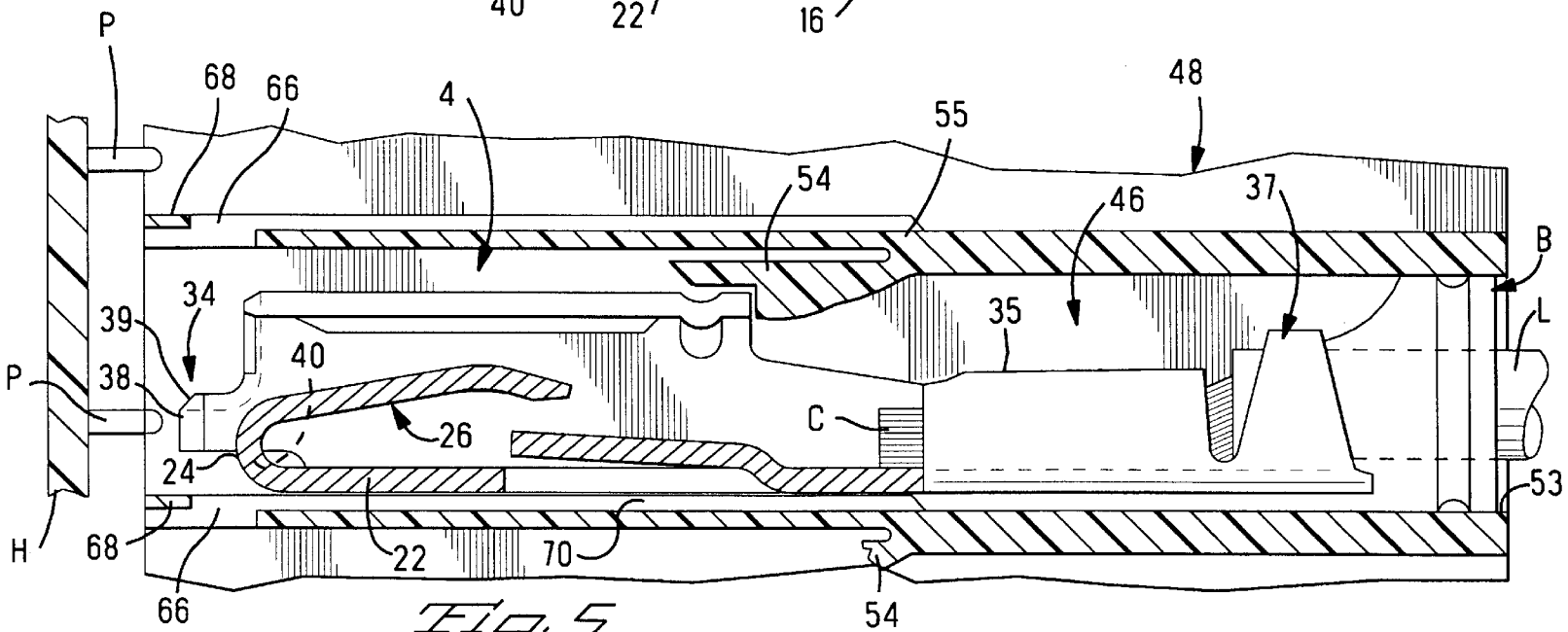
FIG. 5 is a side view, mainly in longitudinal section, of the terminal when crimped to an electrical lead and a bung seal and received in a cavity in an insulating housing (shown in fragmentary form) in association with a harness board, also shown in fragmentary form, and being provided with test probes.
Figure 6:
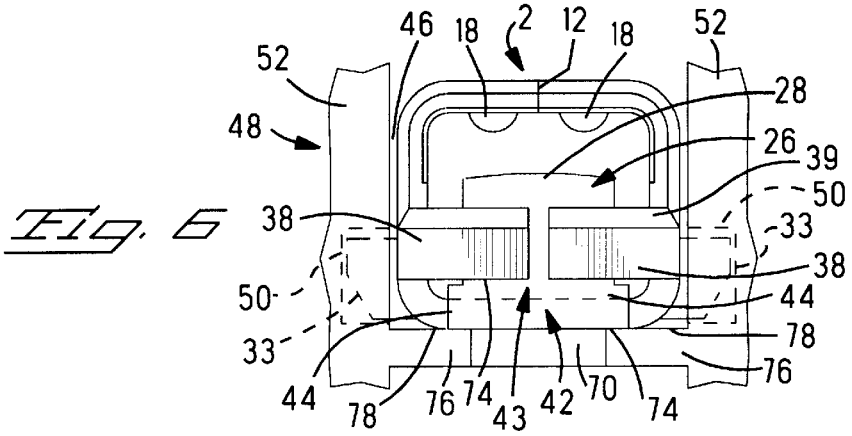
FIG. 6 is a front view of the terminal when received in its cavity, the housing being shown in fragmentary form.
Figure 7:
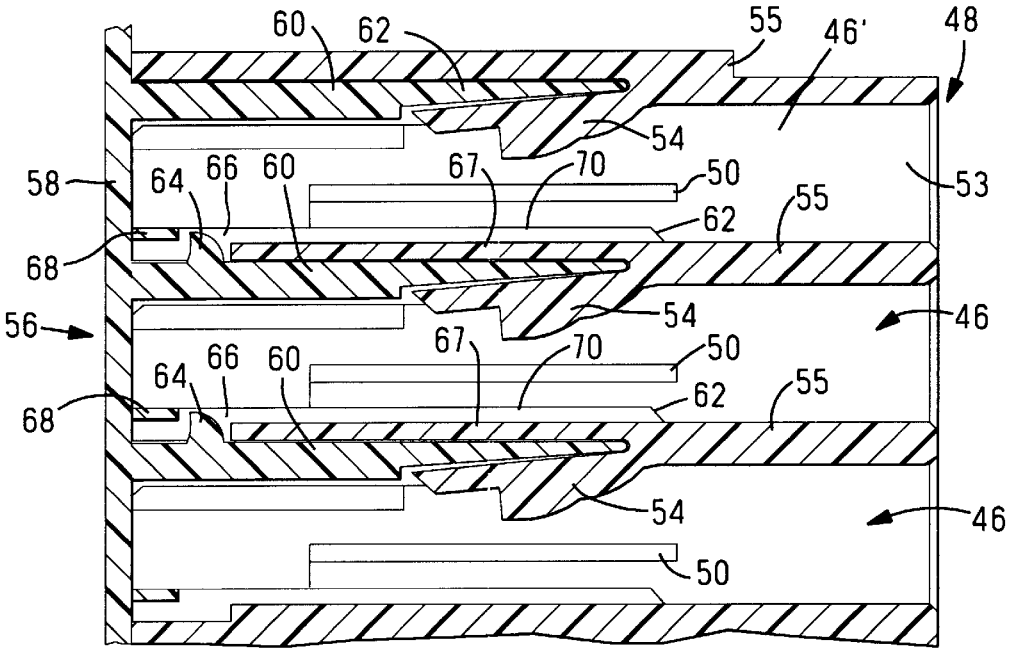
FIG. 7 is a longitudinal sectional view of the housing mated with a secondary locking device and without terminals therein.
Figure 8:
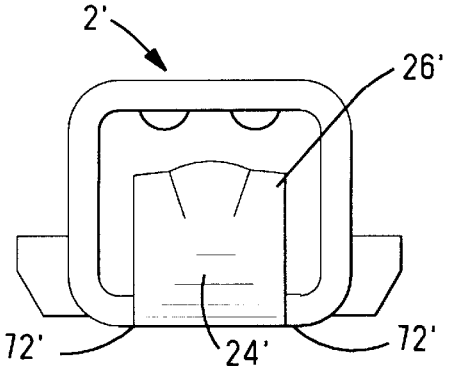
FIG. 8 is a front view drawn to a smaller scale, of a known receptacle terminal.

The use of the barrier 43 comprising the barrier halves 34 will now be described with particular reference to FIGS. 5, 6, and 8. As shown in FIG. 5, the terminal 2 is received in a cavity 46 in a moulded insulating housing 48, one column of cavities of which is shown in FIG. 7. The stabilising ears 33 are received in slots 50 in the side walls 52 of the cavity 56 as shown in FIG. 6. The crimping barrel 35 of the terminal 2 has been crimped to the conductor C of an insulated electrical lead L, the crimping barrel 37 having been crimped to the insulation of the lead L and to a bung seal B for sealing the rear end 53 of the cavity 46. For testing circuit continuity and contact seating during a harness making operation, in which the connector is included, are test probes P in the harness board H. If the terminals of the connector where terminals 2' of known type, as shown in FIG. 8, each test probe P would engage the bight 24' of the terminal 2' and could thus stress or deform the bight 24' and thus the contact spring 26' of the terminal 2', especially if the probe P had been bent as a result of usage. The provision of the barrier halves 34 of the terminal 2 according to this embodiment, prevents such disadvantage, since the probe P can only engage one or both of the barrier bars 38 SO that the contact spring 26 is fully protected from damage. The chamfered upper edges 39 of the barrier bars 38 serve to deflect even a badly bent probe P from the contact spring 26, or to deflect a downwardly displaced tab T, inserted axially of the terminal on to the contact spring. In the present example, the terminal 2 could not be probed from the rear because of the presence of the bung seal B. Even so, it is the usual practice in a harness making operation, to probe the terminals of a connector from the front of its housing, even if the terminals are accessible from the rear thereof.

The use of the sledge 42 will now be described with particular reference to FIGS. 6 to 8. Following the test procedure, the housing 48 is mated with a snap action insulating secondary locking device 56 comprising a front plate 58 covering the front of the housing 48. Secondary locking spigots 60 projecting from the plate 58 each have a nose 62 which projects between the roof 55 of the respective cavity and a latch 54 formed integrally with the roof for retaining the terminal in its cavity, as will best be apparent from FIG. 5. Thus the secondary device 56 ensures that the terminals cannot back out from their cavities even under the action of shock or vibration. Although the front plate 58 may be apertured to provide for probe access, it has been found to be preferable, in practice, to probe the terminals before the secondary locking device 56 has been mated with the housing 48. In order to secure the device 56 in its mated position, each spigot 60 excepting in the top and cavity 46' has a latch member 64 (FIG. 7) which projects into a hole 66 of the cavity top wall 55 which provides the floor 67 of the cavity thereabove. In its latching position, each latch member 64 overlaps a forward end portion 68 of the top wall 55 whereby the device 58 cannot be withdrawn from the housing 48 without the use of a tool. In order to provide the holes 66, by the use of conventional coring techniques when the housing 48 is being moulded, a central channel 70 is formed in the floor 67, the channel 70 extending back from the hole 66. The channel 70 is of approximately the same width as the bight 24' and contact spring 26' of the known terminal 2' shown in FIG. 8. Thus if the terminal 2' were to be inserted into one of the cavities 46, rough, sheared, lower edges 72' of the bight 24' of the known terminal 2', would bight into, and scrape along, the top edges 74 (FIG. 6) of the walls 76 bounding the channel 70. Thus the insertion of the terminal 2' into its cavity 46 would be greatly increased by such interference, with consequent damage to the edges 74.

By virtue of the provision of the sledge 42, when a terminal 2 according to the present embodiment is inserted into cavity 46, the smooth undersides of the runners 44 of the sledge 42 run smoothly along the upper surfaces 78 of the channel walls 76, as will be apparent from FIG. 6, with the sledge 42 thus bridging the channel 70, so that insertion of the terminal 2 into its cavity 46 is unimpeded. Since the forward portions of the runners 44 extend from the bottom part of the bight 24 from the position 40 mentioned above, the sledge 42 has a forwardly bowed forward end that is devoid of any sheared edge.

I claim:

1. An electrical receptacle terminal for reception in a cavity in an insulating housing, the terminal having a rear portion for connection to an electrical conductor and a forward receptacle portion for mating with a male contact member, the receptacle portion comprising a pair of spaced, opposed side walls connected by a contact spring support base, and a contact spring joined to the forward end of the support base by a forwardly bowed bight and extending therefrom obliquely rearwardly, the terminal characterized in that the forward end portion of the contact spring support base and a portion of the bight adjacent thereto are laterally enlarged to provide a sledge of greater width than the remainder of the bight and having laterally projecting runners with smooth rolled undersides for sliding on respective wall surfaces of the cavity, which are spaced from one another by approximately the width of the remainder of the bight.

2. The terminal as claimed in claim 1, wherein a barrier extends from the receptacle portion across the bight, forwardly thereof, to protect the contact spring from damage by a test probe or mating terminal advanced towards the bight in the rearward direction of the terminal.

3. A terminal as claimed in claim 2, wherein the barrier comprises a pair of barrier bars extending towards each other, each from the forward end of a respective one of the side walls of the receptacle portion.

4. A terminal as claimed in claim 3, wherein each barrier bar is connected to its respective side wall by means standing the barrier bar off forwardly from the forward end of the receptacle side wall and forwardly of the bight.

5. A terminal as claimed in claim 2, wherein the barrier has a chamfered upper surface for deflecting the test probe or tab from the contact spring.

6. A terminal as claimed in claim 2, wherein an upper surface of the barrier lies above the bight that extends from the contact spring support base so that a mating tab is prevented from stubbing against the bight.

7. The terminal as claimed in claim 1, wherein a stabilizing ear, receivable in a slot in a side wall of the cavity during insertion of the terminal, extends out of each side wall.

8. An electrical terminal for insertion in a cavity of an insulating housing, the terminal having a forward receptacle portion for mating with a male contact member, the receptacle portion comprising a contact spring support base and a contact spring joined to the forward end of the support base by a forwardly bowed bight and extending therefrom obliquely rearwardly, wherein the forward end portion of the contact spring support base and a portion of the bight adjacent thereto are laterally enlarged to provide a sledge of a greater width than the remainder of the bight and having laterally projecting runners with smooth rolled undersides for sliding on respective wall surfaces of the cavity which are spaced from one another by approximately the width of the bight.

* * * * *